US011651916B2

(12) United States Patent
Bossoni et al.

(10) Patent No.: US 11,651,916 B2
(45) Date of Patent: May 16, 2023

(54) SWITCHING DEVICE OR CONTACTOR WITH HIGH ARC EXTINGUISHING CAPABILITIES

(71) Applicant: MICROELETTRICA SCIENTIFICA S.P.A, Buccinasco (IT)

(72) Inventors: Carlo Bossoni, Milan (IT); Albino Pellizzi, Milan (IT)

(73) Assignee: MICROELETTRICA SCIENTIFICA S.P.A.

( * ) Notice: Subject to any disclaimer, the term of this patent is extended or adjusted under 35 U.S.C. 154(b) by 0 days.

(21) Appl. No.: 17/277,088

(22) PCT Filed: Aug. 27, 2019

(86) PCT No.: PCT/EP2019/072795
§ 371 (c)(1),
(2) Date: Mar. 17, 2021

(87) PCT Pub. No.: WO2020/057906
PCT Pub. Date: Mar. 26, 2020

(65) Prior Publication Data

US 2021/0383991 A1 Dec. 9, 2021

(30) Foreign Application Priority Data

Sep. 17, 2018 (EP) ..... 18194780

(51) Int. Cl.
*H01H 33/08* (2006.01)
*H01H 33/18* (2006.01)
*H01H 33/53* (2006.01)

(52) U.S. Cl.
CPC ..... *H01H 33/08* (2013.01); *H01H 33/182* (2013.01); *H01H 33/53* (2013.01)

(58) Field of Classification Search
CPC ..... H01H 33/08; H01H 33/182; H01H 33/53; H01H 33/596; H01H 9/46; H01H 9/44;
(Continued)

(56) References Cited

U.S. PATENT DOCUMENTS 2,575,060 A * 11/1951 Matthias ..... H01H 9/443 218/25
5,138,122 A * 8/1992 Moldovan ..... H01H 51/12 218/22

(Continued)

FOREIGN PATENT DOCUMENTS

EP 3293748 A1 3/2018
NL 94919 C 7/1960

(Continued)

OTHER PUBLICATIONS

International Search Report and Written Opinion corresponding to PCT/EP2019/072795 dated Dec. 18, 2019.

(Continued)

*Primary Examiner* — William A Bolton
(74) *Attorney, Agent, or Firm* — Barnes & Thornburg LLP

(57) ABSTRACT

An improved switching or contactor device with high arc extinguishing capabilities industrial and railways applications where a high current must be switched on and off is provided. The switching or contactor device includes, in a casing, a switch base portion including electrical switching means of a low voltage driving portion active on moving contacts; a high voltage portion including the moving contacts driven towards and away from each other with respect to a mutual contact position, said moving contacts being mounted at respective contact ends of a toggle mechanism (Continued)

which is movable by a low voltage driving portion, and a top arc chute extinguishing portion covering the high voltage portion.

11 Claims, 7 Drawing Sheets

(58) Field of Classification Search
CPC ..... H01H 9/443; H01H 9/446; H01H 3/28; H01H 3/46; H01H 71/1045; H01H 9/342; H01H 9/345; H01H 3/38
USPC ..... 218/149, 20, 22, 23, 26, 31, 32, 34
See application file for complete search history.

(56) References Cited

U.S. PATENT DOCUMENTS

| | | | | |
|---|---|---|---|---|
| 7,417,520 | B2 * | 8/2008 | Kralik | H01H 9/44 200/10 |
| 9,218,918 | B2 | 12/2015 | Lauraire et al. | |
| 9,299,509 | B2 * | 3/2016 | Coquil | H01H 1/2041 |
| 9,406,465 | B1 | 8/2016 | Fasano | |
| 9,552,944 | B2 * | 1/2017 | Baujan | H01H 33/182 |
| 9,558,899 | B2 * | 1/2017 | Kreuzpointner | H01H 33/08 |
| 9,646,784 | B2 | 5/2017 | Ignatov et al. | |
| 9,991,073 | B2 * | 6/2018 | Kralik | H01H 9/46 |
| 2013/0240495 | A1 * | 9/2013 | Yano | H01H 9/36 219/123 |
| 2019/0214205 | A1 * | 7/2019 | Mondellini | H01H 3/28 |

FOREIGN PATENT DOCUMENTS

| | | | |
|---|---|---|---|
| RU | 2381589 | C1 | 2/2010 |
| RU | 2396627 | C2 | 8/2010 |
| RU | 2451358 | C2 | 5/2012 |
| RU | 2510673 | C2 | 4/2014 |
| RU | 2562123 | C9 | 11/2015 |
| RU | 162074 | U1 | 5/2016 |
| RU | 2594754 | C2 | 8/2016 |

OTHER PUBLICATIONS

Office Action with respect to a Hearing from the Indian Patent Office for corresponding POK/Application No. 202137016327 dated Mar. 24, 2023.

* cited by examiner

SWITCHING DEVICE OR CONTACTOR WITH HIGH ARC EXTINGUISHING CAPABILITIES

CROSS REFERENCE AND PRIORITY CLAIM

This patent application is a U.S. National Phase of International Patent Application No. PCT/EP2019/072795 filed Aug. 27, 2019, which claims priority to European Patent Application No. 18194780.5, the disclosure of which being incorporated herein by reference in their entireties.

FIELD

The disclosed embodiments relate to an improved switching device or contactor with high arc extinguishing capabilities for industrial and railways applications. More specifically, but not exclusively, the disclosed embodiments relate to a contactor device for industrial and/or railways applications wherein, for instance, a high D.C. current must be switched on and off with high capacity of switching actions to control electric motors, lighting, heating, capacitor banks, thermal evaporators, and other electrical loads.

BACKGROUND

As it is well known in this specific technical filed, contactors are remotely controlled switches including an electromagnetic actuator that may be used in many industrial or railways applications wherein a high A.C. or D.C. current must be switched on and off with relatively high frequencies switching actions.

Generally speaking, a contactor may be considered a switching device for high current and voltage applications, no matter which is the electric load to be driven.

Just to give an idea of the working conditions and the range of current values involved for these kind of contactors, it should be noted that these devices must be able to efficiently switch currents at least in the range between 400 A to 1800 A and under operating voltage ranges between 1000 V and 4000 V.

Those operating ranges may even be referred to a single pole of the contactor but in many applications, it is however necessary to provide a double or a three poles configuration.

A contactor of known structure normally include fixed contacts, movable contacts and at least a contactor coil. In normally open devices, when a sufficient starting current flows through the contactor coil, the contactor responds and turns on the loads connected in the load circuit.

To maintain the contactor in this state, a holding current must continuously flow through the contactor. After the holding current is switched off, the contactor drops out. The energy stored in the contactor coil is dissipated in a free-wheeling circuit or, better, in a quick and proper overvoltage protection, like a Varistor or a Transil.

Contactors of high quality and performance require an arc extinguishing portion, so-called arc chute portion, for properly extinction of the electric arc that may be generated in the high voltage portion of the switch where the movable contacts are provided.

One of the main problems encountered in the manufacturing of the switching devices for high current and voltage applications is=the correct dimensioning of the arc extinguishing portion.

SUMMARY

The disclosed embodiments provide an improved switching device or contactor for high current or high voltage switching applications having such structural and functional characteristics to allow a more efficient dissipation of the electric arc that may be generated during the opening or closure phase of the movable contacts thus conferring to the device higher arc extinguishing capabilities.

Disclosed embodiments provide a switching device having a higher reliability and a longer operating life due to a higher efficiency in the turn off phase of the possible electric arc.

Disclosed embodiments provide a switching device that may be constructed with materials having reasonable industrial costs.

DETAILED DESCRIPTION

Figure 1:
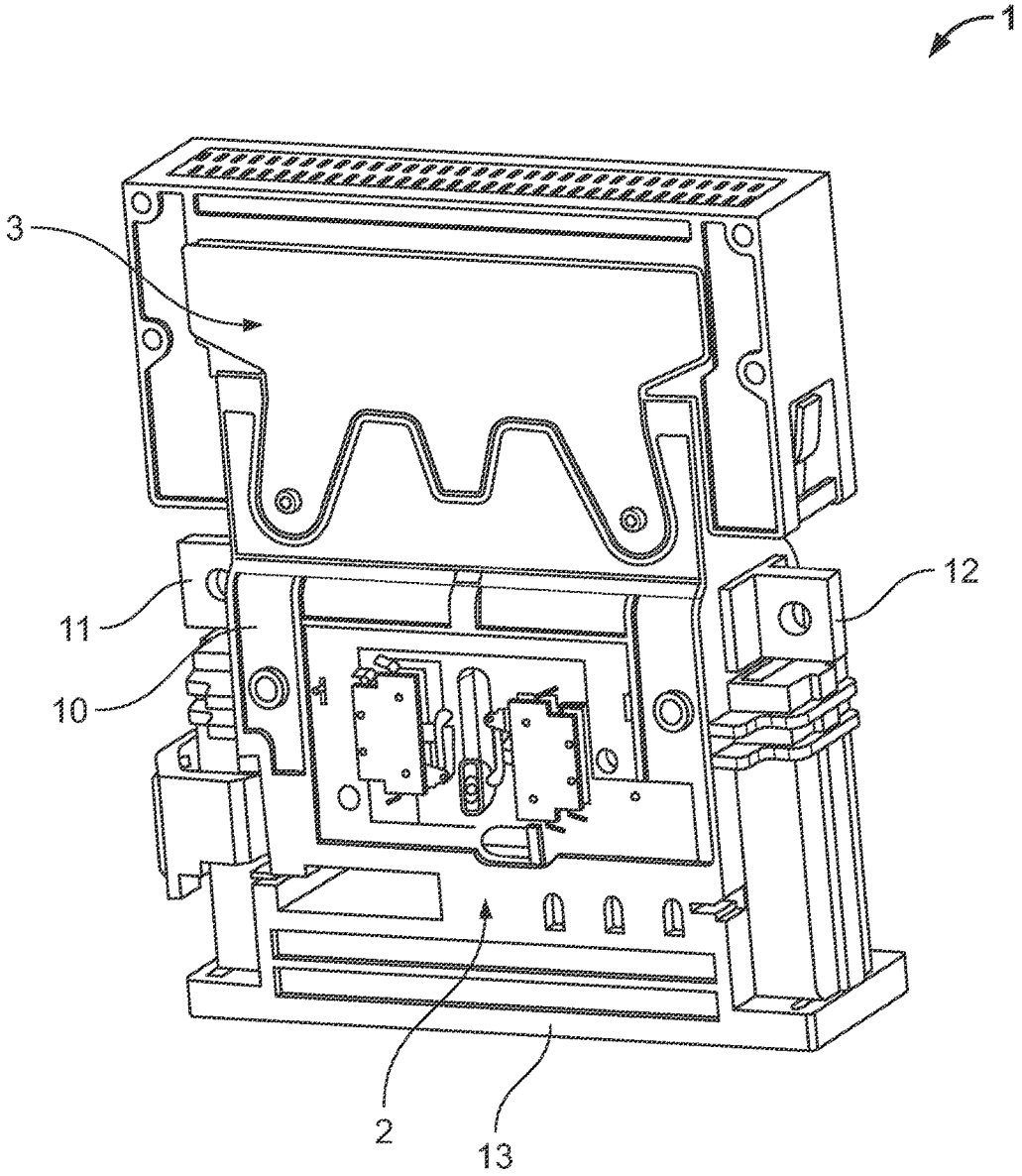
FIG. 1 shows a schematic and perspective view of a switching device or contactor realized according to the disclosed embodiments.

The design phase is particularly critical since the arc chute portion requires sometimes to be enlarged and expanded according to the version of the switching device; in other words, according to the operating current or voltage that the switching device must manage. Moreover, the extinguishing phase of the electric arc is a real problem when the contactor is used for low current applications.

As a matter of fact, the contactors are generally designed to switch high currents and when the switched current is under a predetermined threshold, for instance of few Ampere only, the magnetic field generated in the blow-out coil is not sufficient to detour the electric arc toward the extinguishing chamber. Such a current which is not sufficient to detour the electric arc toward the extinguishing chamber is defined as a "low (switched) current". Such a current is also known as "critical current".

The technical problem underlying the present disclosed embodiments is that of providing an improved switching device or contactor for high current or high voltage switching applications having such structural and functional characteristics to allow a more efficient dissipation of the electric arc that may be generated during the opening or closure phase of the movable contacts thus conferring to the device higher arc extinguishing capabilities.

Another aim of the present disclosed embodiments is that of providing a switching device having a higher reliability and a longer operating life due to a higher efficiency in the turn off phase of the possible electric arc.

A further utility of the present disclosed embodiments is that of providing a switching device that may be constructed with materials having reasonable industrial costs.

Disclosed embodiments provide hardware means able to blow out the electric arc when low currents are switched by the contactor.

These hardware means preferably include magnetic elements positioned in the proximity of moving contacts of the contactor to generate a magnetic field sufficient to at least partially detour the electric arc and to extinguish the arc generated when low switched currents are involved. Advantageously, those magnetic elements are permanent magnets.

According to the disclosed embodiments and to one aspect of the disclosed embodiments, the technical problem is solved by an improved switching device or contactor having high arc extinguishing capabilities and comprising, in a protective casing:

a switch base portion including electrical switching means of a low voltage driving portion active on moving contacts;

a high voltage portion including the moving contacts driven towards and away from each other with respect to a mutual contact position, the moving contacts being mounted at respective contact ends of a toggle mechanism which is movable by a low voltage driving portion, and a top arc chute extinguishing portion covering the high voltage portion.

Hardware is provided in the proximity of the moving contacts to influence an electric arc occurring when currents are switched on and off by the moving contacts moving towards and away from each other. Advantageously, the hardware means include magnetic elements positioned close to the moving contacts to generate a magnetic field sufficient to at least partially detour the electric arc when low switched currents are involved.

Advantageously, the magnetic elements are permanent magnets.

Moreover, advantageously, the magnetic elements are positioned at each lateral side of each moving contact.

Each of the magnetic elements is structured as a disk supported laterally of a corresponding moving contact in a fixed position when the moving contacts are in the rest or open position.

Advantageously, the contactor of the disclosed embodiments includes at least four magnetic elements, two for each moving contact.

Advantageously, the hardware is active to detour the electric arc toward the top arc chute and they are mainly active when the low currents are not enough, when flowing through the blow out coil, to generate the proper electromagnetic force.

Arc runners are advantageously provided over each corresponding moving contact in their open or rest position and the hardware means including magnetic elements are positioned at both sides of each arc runner.

Each arc runner is advantageously formed by a flat metal plate extended over the corresponding moving contact and bent on both lateral sides with opposite flanges that partially and laterally protect the corresponding moving contact; the magnetic elements being positioned at both sides of the opposite flanges.

Further features and advantages of the switching or contactor device of the disclosed embodiments will appear from the following description given by way of not limiting example with reference to the disclosed Figures.

With reference to the Figures, FIG. 1 is globally and schematically shown a switching or contactor device realized according to the disclosed embodiments.

In particular, but not exclusively, the contactor 1 is specifically provided for industrial or railways applications wherein, for instance, a high D.C. current must be switched on and off with high frequencies switching actions to control electric motors, lighting, heating, capacitor banks, thermal evaporators, and other electrical loads.

Just to give an idea of the working conditions and the range of current values involved for these kind of contactors, it should be noted that these devices must be able to efficiently switch currents at least in the range between 400 A to 1800 A and under operating voltage ranges between 1000 V and 4000 V. For instance, a LTX family of line contactors is structured to operate under high voltage rating, high thermal current and when high breaking capacity (up to 4 kV) are required.

Those operating ranges may even be referred to a single pole of the contactor. In many applications it is however necessary to provide a double pole configuration and/or a three poles configuration that may be obtained by coupling single poles side by side thanks to a modular single pole structure, even if not shown in the drawings.

In the following lines just the structure of a single pole module is detailed, as the same principle is applied on each couple of moving contacts even installed in a bipolar or tripolar contactor.

The module presents an envelope or housing 10 protecting and covering all the moving portions of the contactor device 1. The envelope 10 is made by a synthetic plastic material having a predetermined isolation coefficient and high coefficient of trace index CTI. Such an envelope 10 has a base flange 13 and includes an internal frame 20 supporting the various moving components of the contactor 1.

It should be noted that fixed terminal power contacts 11 and 12 are provided for the contactor 1. Those fixed contacts 11, 12 are projecting on opposite lateral sides of the envelope 10; however, other dispositions may be adopted.

Those terminal power contacts 11, 12 are each associated to a corresponding internal moving contact 21, 22 provided inside the contactor device 1, as will be explained hereinafter. Advantageously, the creepage and clearance distances between the moving contacts 21 and 22 has been widely dimensioned for safe applications in polluted environments but the narrow outline of the envelope 10 is especially conceived for applications where space is a critical issue.

The contactor 1 of the disclosed embodiments is structured to be used on electrical equipment working in presence of severe shocks and vibrations that normally occurs onboard of traction vehicles. However, nothing refrains from employing this kind of contactors 1 in all the applications wherein a high A.C or D.C. current must be switched on and off, for instance: line contactors, power switches or converters, traction motors, electromagnetic brakes and heating/air conditioning systems.

The contactor 1 comprises a switch base portion 2 and an upper arc extinguishing portion 3. The innovative design (of LTX line) of the disclosed embodiments combines the traditional technology of the arc chute (ceramic fins) with a new blow out system. Ceramic arc chute enables to withstand the highest current ratings and the new blowout system guarantees a high reliability with critical currents.

The switch base portion 2 is common for each different modular contactor 1 and corresponds to the main structure of the envelope 10 while the upper arc extinguishing portion 3 may be considered as a top coverage of the envelope 10 that may have a different size according to the different power category and voltage ranges that the contactor shall provide. The switch base portion 2 includes electrical switching means 35.

Figure 7:
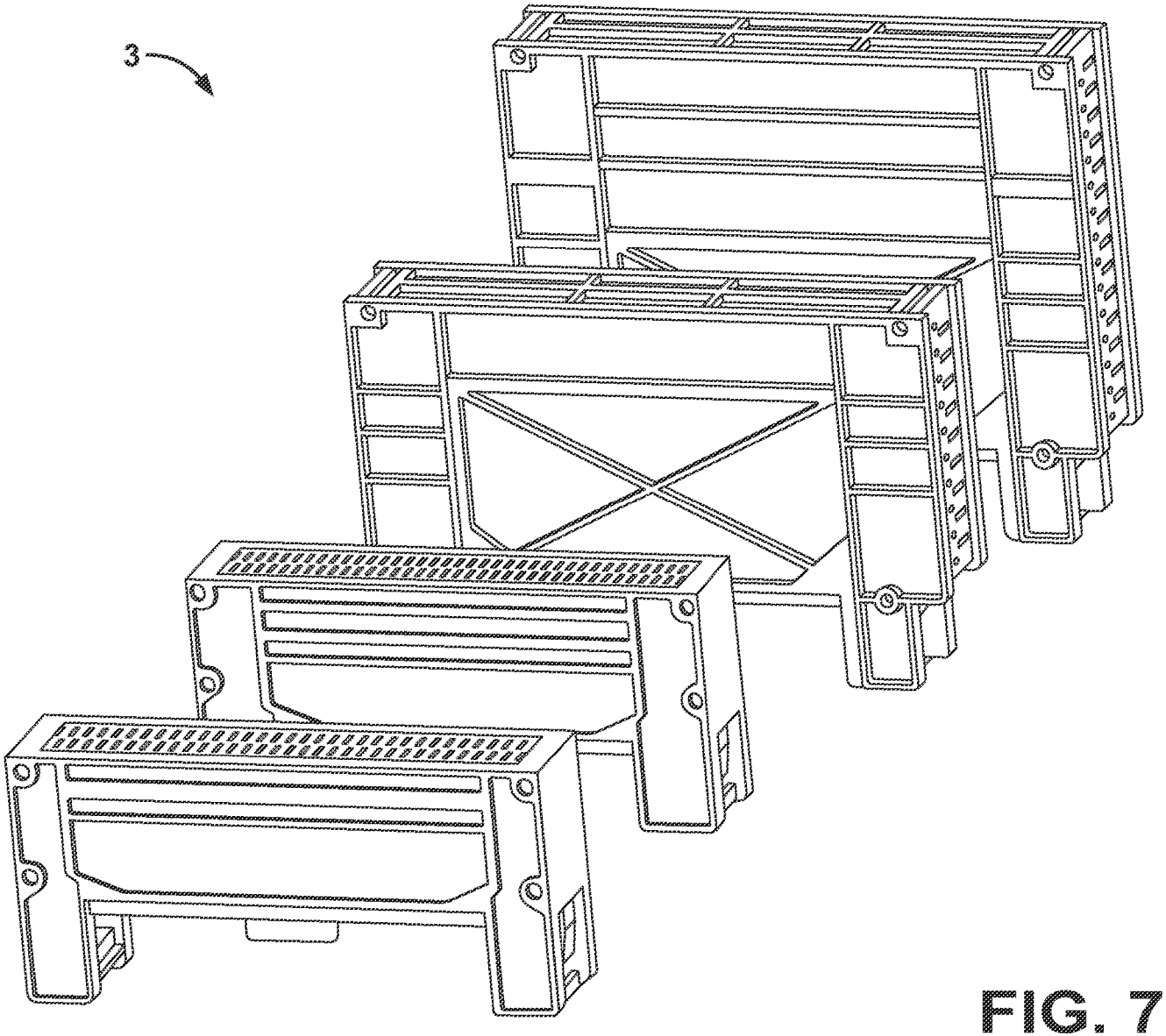
FIG. 7 shows a perspective view of different arc chute portions according to the disclosed embodiments.

The upper arc extinguishing portion 3 may be structurally different according to the different voltage ranges, as shown in FIG. 7, that must be treated and the corresponding arc chute type and energy capacity that shall be extinguished in total security.

Figure 2:
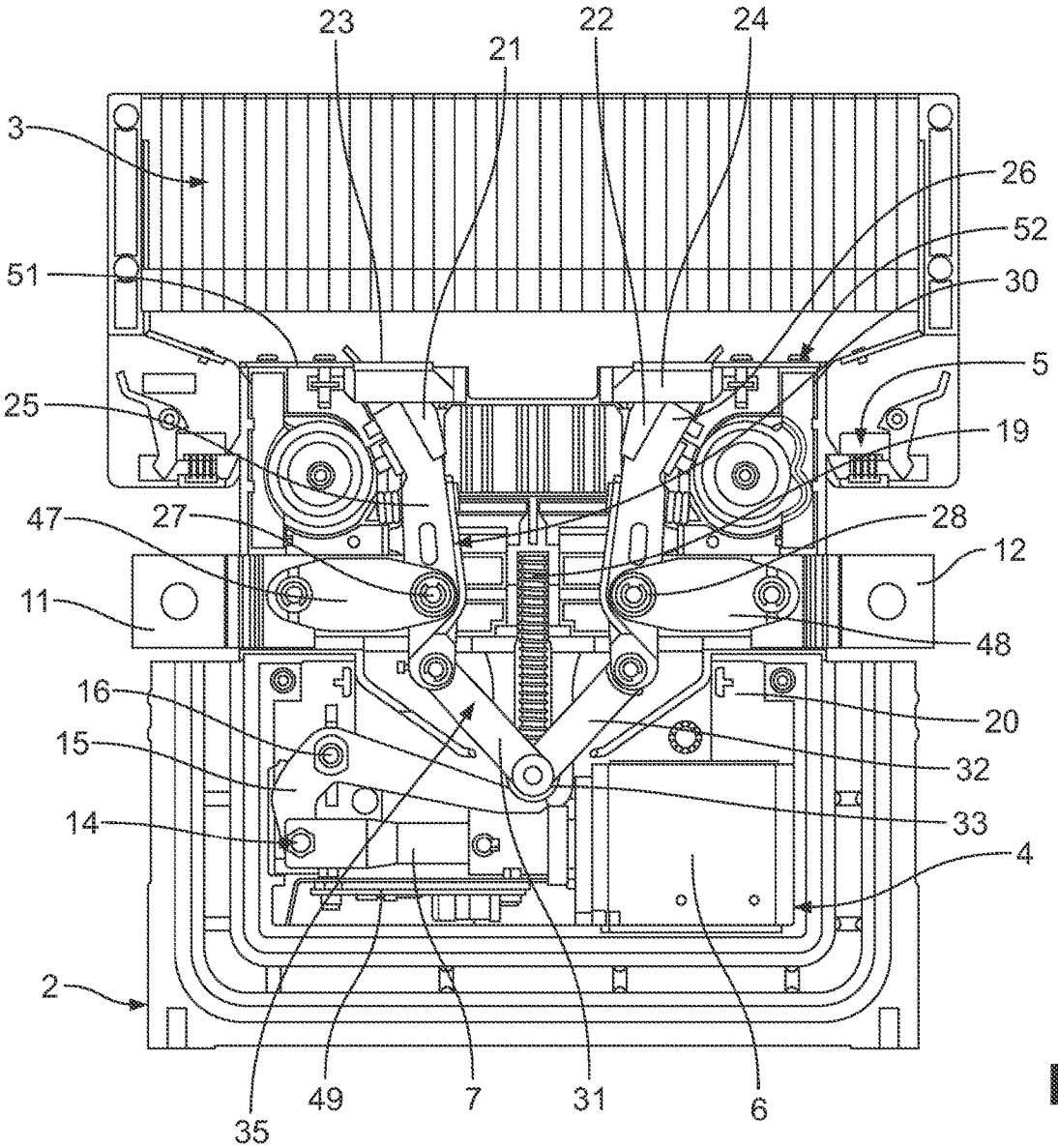
FIG. 2 shows a schematic and front view of the switching or contactor device of FIG. 1 with a lateral cover removed.
Figure 3:
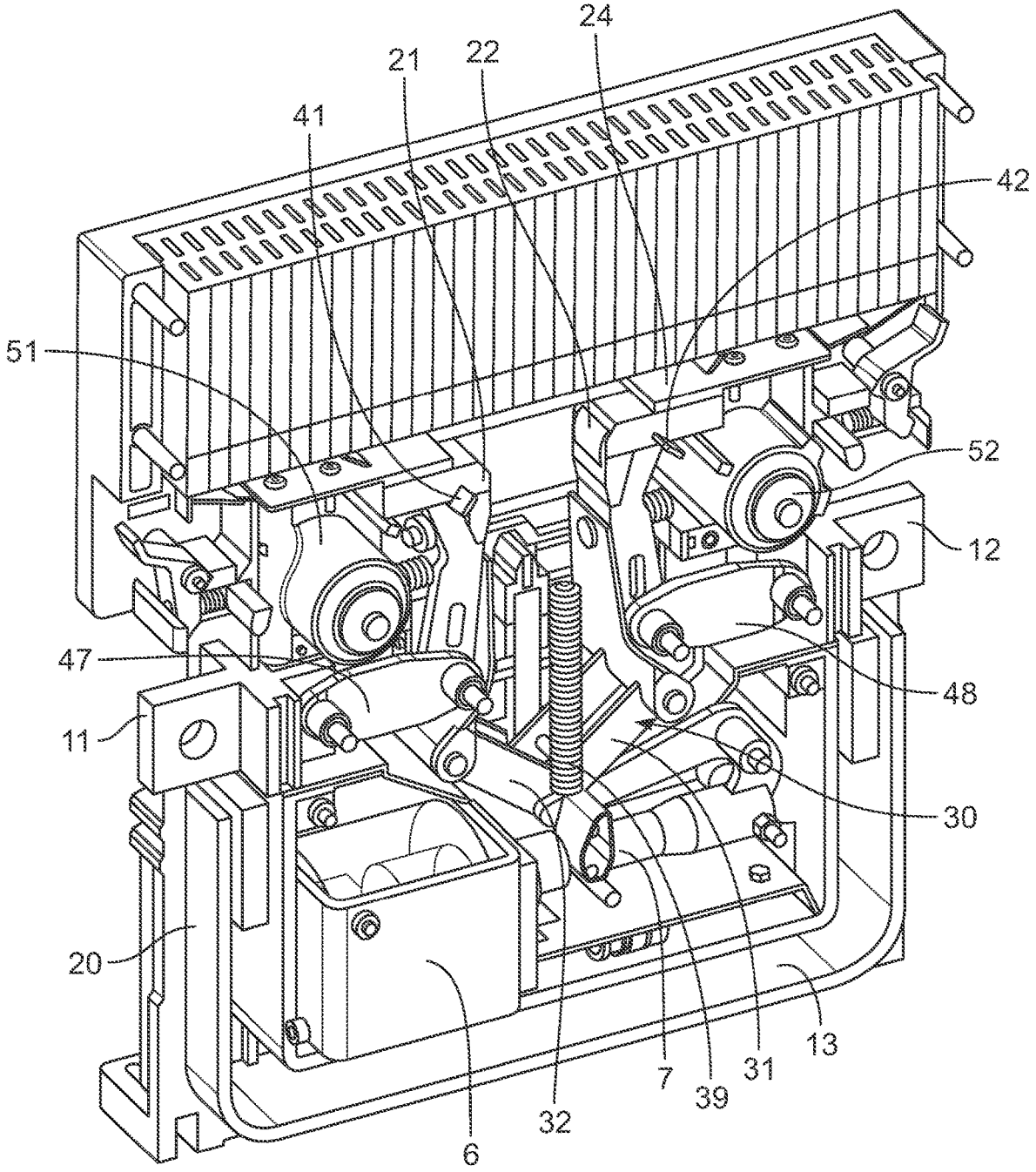
FIG. 3 shows a schematic and perspective view of the switching device of FIG. 1 with a lateral cover removed.

An arc extinguishing portion 3 for a voltage value of 1000 V may have the structure shown in FIG. 1, 2 or 3 while an arc extinguishing portion for a higher voltage value up to 3000 V may require a greater or thicker extinguishing portion and larger polar expansions.

Figure 4:
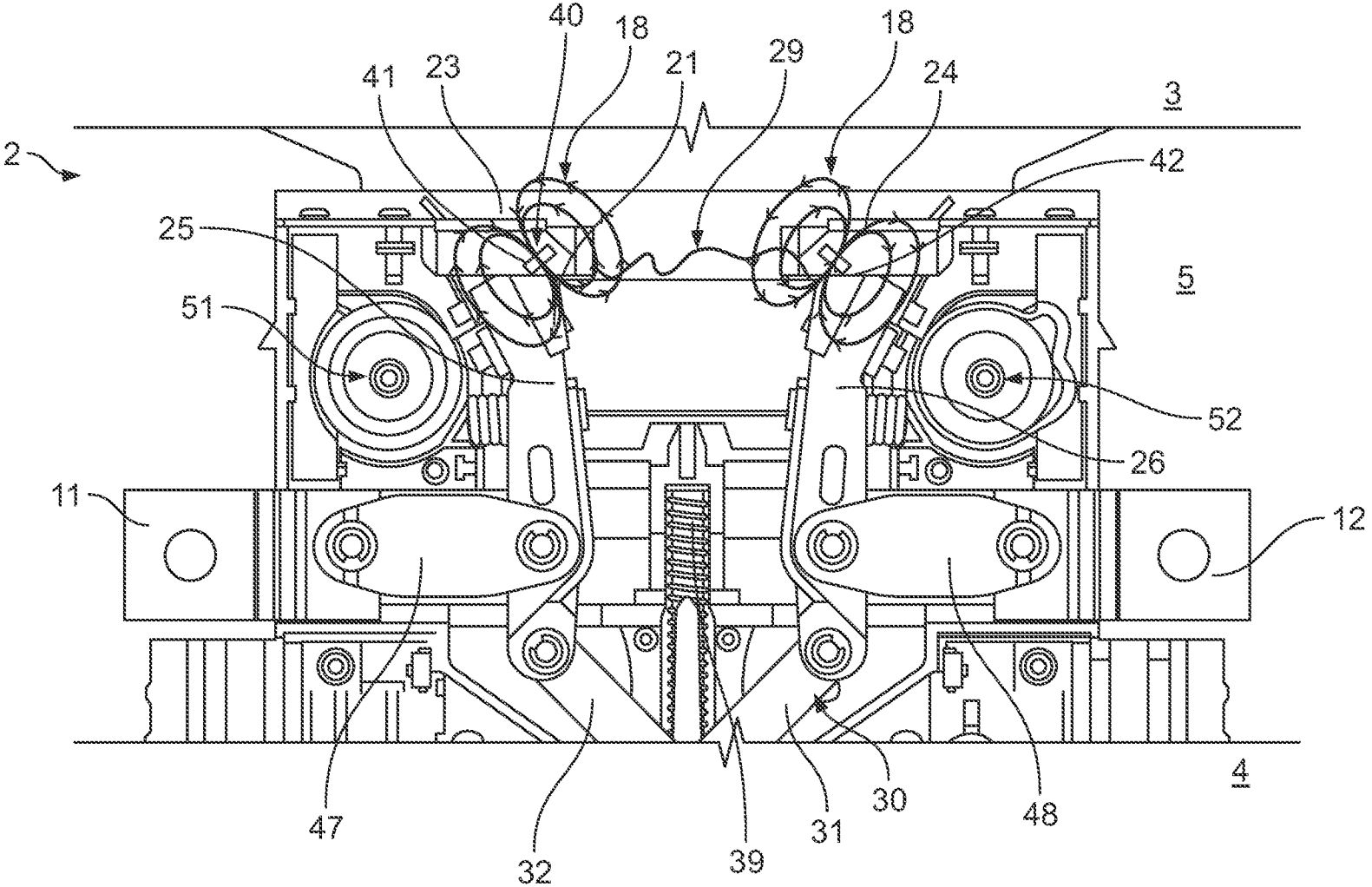
FIG. 4 shows a schematic enlarged front view of a central upper portion of the contactor device of FIGS. 2 and 3.
Figure 5:
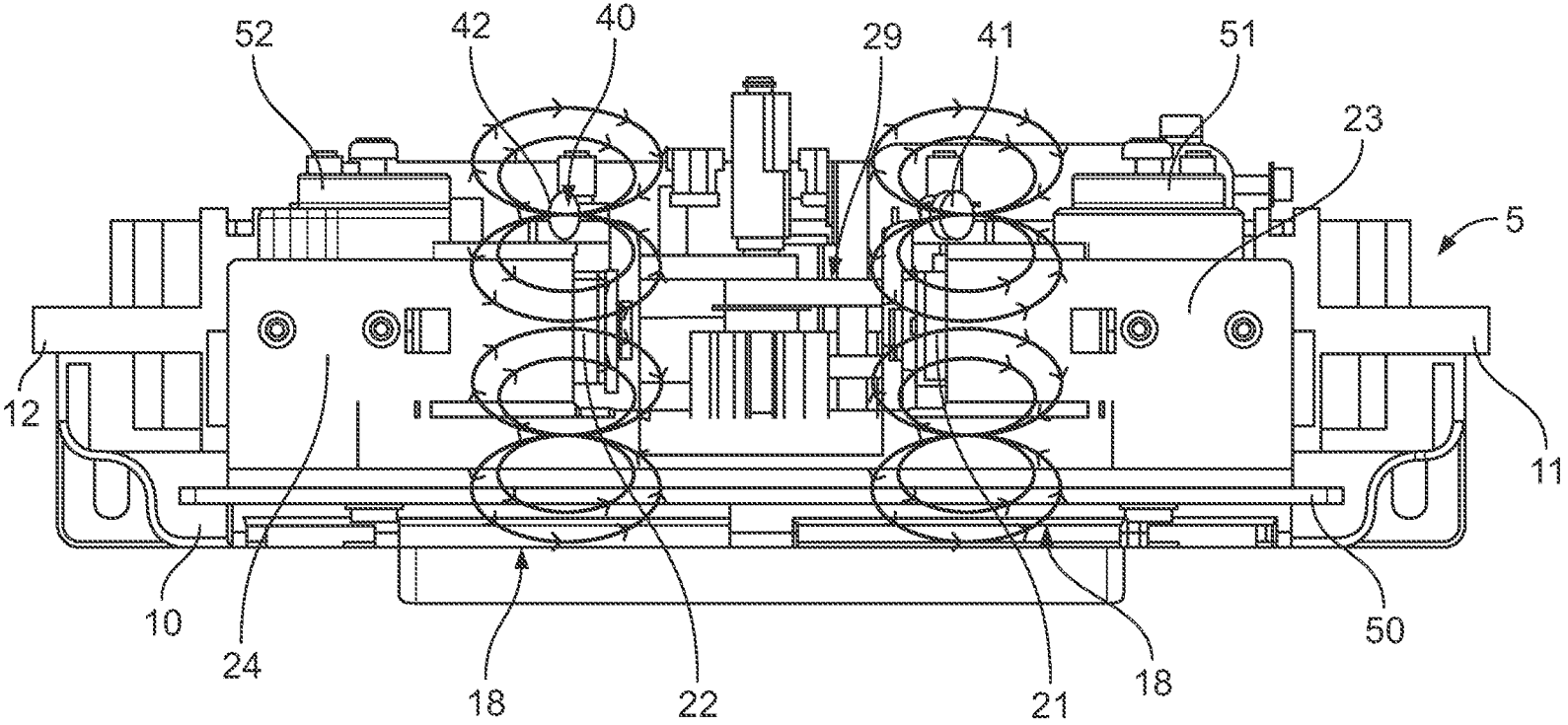
FIG. 5 shows a schematic and top view of a single pole contactor according the disclosed embodiments with the arc chute portion removed and a visible upper extinguishing arc portion.
Figure 6:
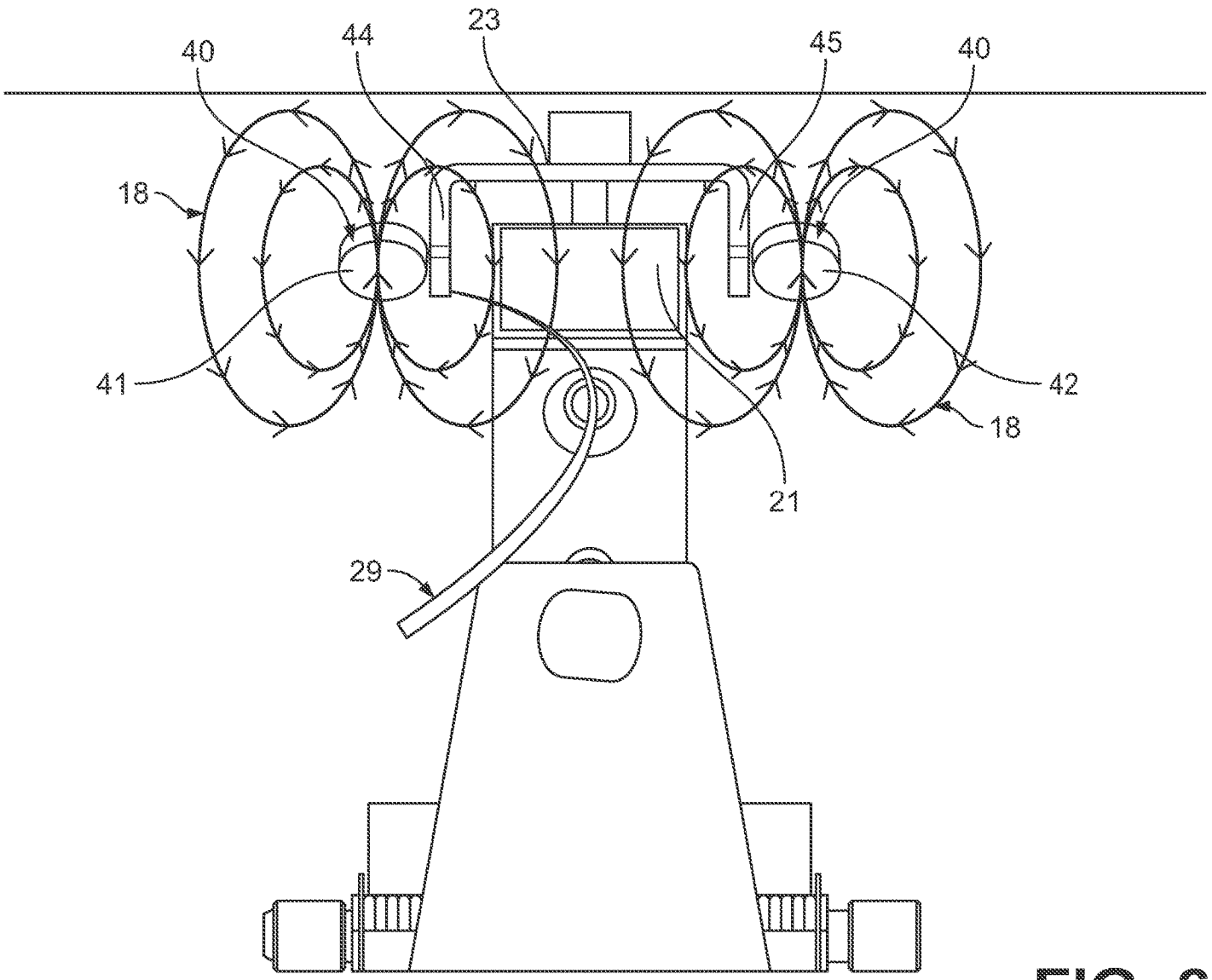
FIG. 6 shows a schematic and lateral view of a movable contact of the contactor portion of FIG. 5 seen from a central point of the contactor.

According to the disclosed embodiments, hardware means 40 are provided in the switch base portion 2 of the contactor 1 for attracting the electric arc when relatively low currents are switched by the contactor 1. Such an electric arc is schematically shown in FIGS. 4, 5 and 6 with the number 29.

These hardware means 40 include magnetic elements 41, 42 positioned in the proximity of the moving contacts 21, 22 of the contactor 1 to generate a magnetic field 18 sufficient to partially detour the electric arc 29 and to extinguish such an arc 29 generated in particular when low switched currents are involved.

Advantageously, those magnetic elements 41, 42 are permanent magnets.

Moreover, the magnetic elements 41, 42 are positioned at each lateral side of each moving contact 21, 22.

Each of the magnetic elements 41, 42 is structured as a disk supported laterally of a corresponding moving contact 21, 22 in a fixed position when the moving contacts 21, 22 are in the rest at the open position.

The shown embodiment of the contactor 1 includes at least four magnetic elements 41, 42, that is two for each moving contact 21, 22.

The hardware means are active to detour the electric arc toward the top arc chute and they are mainly active when the low currents are flowing through the main contacts.

These magnetic elements 41, 42 are supported in the casing 10 in an inclined position substantially perpendicular to a corresponding moving contact 21, 22 and at predetermined distance of few millimeters from arc runners 23, 24.

The internal schematic structure of this switch base portion 2 including the electrical switching means 35 is shown in FIG. 2.

The switch portion 2 may be separated in a low voltage portion 4 and a high voltage portion 5 located over the low voltage portion 4. The low voltage portion 4 is provided for driving the switching of the internal moving contacts 21, 22 of the upper high voltage portion 5.

The contactor 1 of the disclosed embodiments is a monostable element that is provided with normally open contacts according to the vast majority of customer requirements.

The internal moving contacts 21 and 22 of the upper high voltage portion 5 are put in abutment one against the other for allowing the passage or flow of the high DC current. Advantageously, the electrical contacts 21, 22 are symmetrically moving towards and away from each other.

The contactor 1 includes a couple of reciprocally symmetrically moving contacts 21, 22 driven towards and away from each other with respect to a central mutual contact position or abutting position.

Each moving contact 21 or 22 is positioned at the end of a corresponding elongated arm 25, 26 of a toggle mechanism 30, as shown in FIGS. 2 and 3. The arms 25, 26 are manufactured by a conductive material, for instance a metal.

Over the contacts 21, 22, but still part of the switch base portion 2, respective arc runners 23, 24 are provided.

Those arc runners 23, 24 are normally provided to help in dissipating the electric arc 29 formed during the opening phase of the moving contacts 21, 22. Depending on the application, arc running can be installed or not.

Each of the arc runner 23, 24 is electrically connected to a respective dissipation or blow coil 51, 52. Each coil 51, 52 is provided at the shoulder of each moving contact 21, 22 of each arm 25, 26.

Each arc runner 23 or 24 is formed by a flat metal plate extended over the corresponding moving contact 21 or 22 when they are in the open or rest position. The upper flat metal plate is bent on both lateral sides with opposite flanges 44, 45 that partially and laterally protect the corresponding moving contact 21 or 22, as shown in FIG. 6.

The lateral metal flanges 44, 45 represent detouring elements that may attract the arc flow path as a function of the DC current direction, as shown by the arched curves 29 in FIG. 6.

Advantageously, each magnetic element 41 or 42 is located outside a corresponding flange 44 or 45 laterally from the moving contact 21 or 22.

Moreover, a polar expansion 50, that is to say a metal plate, is provided on both sides of the moving contacts 21, 22. In FIG. 5 only one plate 50 is shown since only half a shell of the housing 10 is shown but it should be considered also the presence of a corresponding plate situated in a parallel position on the other side of the envelope with respect to the contacts 21, 22.

For completeness sake we will now disclose the other portions of the contactor 1 that are dedicated to the switching action.

The toggle mechanism 30 shown in FIGS. 2 and 3 includes a couple of legs 31 and 32 that are joined at one end in a sliding hinge 33 that is movable along a vertical slot 19 of the frame 20. The legs 31 and 32 are made by an insulating material, for instance a thermosetting material.

The opposite ends of each of the legs 31, 32 are hingedly linked to a corresponding end of the arms 25 and 26 supporting the moving contacts 21, 22, respectively. More specifically, each end of the arms 25, 26, opposite to the moving contacts 21, 22, is linked to a corresponding end of the legs 31, 32.

Each arm 25 or 26 is pivotally supported in the frame 20 by a corresponding pivot 27, 28 in a position that corresponds substantially to one third of the whole longitudinal length of the arm.

The legs 31, 32 and the arms 25, 26, together with the corresponding hinge joint 33 form the toggle mechanism 30 that allows driving the moving electric contacts 21 and 22 one toward the other and vice versa. The rods 31, 32 as well as the arms 25, 26 are formed by a couple of identical parallel components that are linked together more or less like a truss beam.

Between each of the pivots 27, 28 and the corresponding fixed terminal power contact 11 or 12 there is a fork arm 47, 48 made by a conductive material, such as a metal.

Those fork arms 47, 48 are substantially linked to the fixed terminal power contacts 11 and 12 to provide electric continuity between the moving electric contacts 21, 22 and the fixed terminal contacts 11, 12.

The toggle mechanism 30 is activated by the low voltage driving portion 4 that will be disclosed hereinafter.

The hinge joint 33 is provided with a central annular elastic element 39 that is contacted by an active end of the low voltage driving portion 4 and may be considered as a bumper between the active end and the whole toggle mechanism 30. This hinge joint 33 is forced to slide along the vertical slot 19 by a sliding guide 39, not visible in the drawings.

The low voltage driving portion 4 includes a coil 6 that is electrically supplied by a low voltage reference potential, not shown being of a conventional type and driven by a suitable switching actuator.

The coil 6 is active on a stem 7 that is extended horizontally and parallel to the base flange 13 of the contactor envelope 10 inside the switch base portion 2. The stem 7 is moved against the contrast of an elastic element 8, for instance an elongated spring to be compressed.

The free or distal end 14 of the stem 7 is linked to one end of a lever 15 which is pivotally mounted on a fulcrum 16 fixed or integral with the internal frame 20 of switch base portion 2 of the contactor 1.

The lever 15 has a first arm linked to the free distal end 14 of the stem 7 and another or second arm free to move around the fulcrum 16 when the lever 15 is actuated by the coil 6 and the stem 7.

The free end of this second arm is active on the hinge joint 33 of the toggle mechanism 30.

An electric circuit 49 is provided for supplying the coil 6 related voltage values according to the different needs to drive the low voltage driving portion of the actuator. This circuit 49 is substantially a voltage level shifter suitable to receive a plurality of different voltage values. According to the present embodiment two types of electromagnets or coils 6 have been considered, that is to say: high and low voltage coils having a control card to control starting current and holding current. This electronic control of the main coil allows to combine a high closing power with a reduced power consumption during the holding phase.

In view of the previous description, the functioning of the contactor device 1 of the disclosed embodiments are evident.

According to the solution idea at the basis of the disclosed embodiments, in the contactor device 1 there is not a fixed contact but, on the contrary, a couple of movable contacts 21, 22 that are driven towards and away from each other with respect to a mutual contact position.

According to set initial conditions, the electromagnet 6 of the low voltage driving portion 4 is biased to move the stem 7 that is joined to one end of the two arms lever 15 pivotally hinged on the fulcrum 16.

The movement of the stem 7 moves the free end of the lever 15 that acts on the sliding hinge 33 of the toggle mechanism 30. That sliding hinge 33 is free to move up and down or axially along a slot of the frame 20 so to push up or down and this movement forces the whole toggle mechanism 30 to provide a closure or an aperture of the moving contacts 21, 22 accordingly.

The structure of the double symmetrically moving contacts 21, 22 of the disclosed embodiments allows obtaining a physical separation of the contacts of at least 73 mm that allows reducing the risk of electric arc and renders particularly reliable the switching of the contactor device of the disclosed embodiments with respect of the insulation characteristics.

Contacts 21 and 22 open with double speed and the toggle mechanism 30 guarantees also a higher distance between them.

The magnetic elements 41, 42 positioned at both sides of the opposite flanges 44, 45 of the arc runners 23, 24 allow detouring the electric arc toward the top arc chute 3 mainly when low switching currents are involved.

The contactor according to the disclosed embodiments may be used also for switching in high AC current applications.

In the previous lines the directional terms like: "forward", "rearward", "front", "rear", "up", "down", "above", "below", "upward", "downward", "top", "bottom", "side", "vertical", "horizontal", "perpendicular" and "transverse" as well as any other similar directional terms refer just to the device as shown in the drawings and do not relate to a possible use of the same device. Accordingly, these directional terms, as utilized to describe the contactor in its upright vertical position on a horizontal surface have just the meaning to identify a portion of the device with respect to another portion as shown in the figures.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. This concept also applies to words of similar meaning, for example, the terms "have", "include" and their derivatives.

Moreover, the terms "member", "section", "portion", "part" and "element" when used in the singular can have the dual meaning of a single part or a plurality of parts.

The invention claimed is:

1. A switching or contactor device with high arc extinguishing capabilities, for industrial and railways applications where a high current must be switched on and off, the switching or contactor device comprising:

in a casing:

a switch base portion including an electrical switching component having a low voltage driving portion active on moving contacts;

a high voltage portion including the moving contacts driven towards and away from each other with respect to a mutual contact position, the moving contacts being mounted at respective contact ends of a toggle mechanism which is movable by the low voltage driving portion, a top arc chute extinguishing portion covering the high voltage portion, and hardware provided in a proximity of the moving contacts to influence an electric arc occurring when currents are switched on and off by the moving contacts moving towards and away from each other, wherein the hardware includes magnetic elements, wherein respective arc runners are provided over each corresponding moving contact in respective open or rest positions and the hardware magnetic elements positioned at both sides of each arc runner, wherein each arc runner is electrically connected to a respective blow coil provided at a shoulder of each moving contact.

2. The switching or contactor device of claim 1, wherein the magnetic elements are positioned in proximity to the moving contacts to generate a magnetic field sufficient to partially detour the electric arc when low switched currents are involved.

3. The switching or contactor device of claim 2, wherein the magnetic elements are permanent magnets.

4. The switching or contactor device of claim 2, wherein the magnetic elements are positioned at one lateral side of each moving contact.

5. The switching or contactor device of claim 2, wherein each of the magnetic elements is structured as a disk supported laterally of a corresponding moving contact in a fixed position when the moving contacts are in a rest or open position.

6. The switching or contactor device a of claim 2, wherein the magnetic elements are supported in the casing in an inclined position substantially perpendicular to a corresponding moving contact.

7. The switching or contactor device of claim 1, further comprising at least four magnetic elements two for each moving contact.

8. The switching or contactor device of claim 1, wherein the hardware is active to detour the electric arc toward the top arc chute.

9. The switching or contactor device of claim 1, wherein the hardware is mainly active when low currents have to be switched off.

10. The switching or contactor device of claim 1, wherein each arc runner is formed by a flat metal plate extended over the corresponding moving contact and bent on both lateral sides with opposite flanges that partially and laterally protect the corresponding moving contact; the magnetic elements being positioned at both sides of the opposite flanges.

11. The switching or contactor device of claim 1, wherein the switching or contactor device is for switching a high D.C. current.

* * * * *